US007333058B2

(12) United States Patent
Fontana

(10) Patent No.: US 7,333,058 B2
(45) Date of Patent: Feb. 19, 2008

(54) HEXAGONAL DUAL-POL NOTCH ARRAY ARCHITECTURE HAVING A TRIANGULAR GRID AND CONCENTRIC PHASE CENTERS

(75) Inventor: Thomas Paul Fontana, White Bear Lake, MN (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 11/158,306

(22) Filed: Jun. 22, 2005

(65) Prior Publication Data

US 2006/0290584 A1 Dec. 28, 2006

(51) Int. Cl.
*H01Q 1/38* (2006.01)
*H01Q 13/10* (2006.01)

(52) U.S. Cl. ..... 343/700 MS; 343/770

(58) Field of Classification Search ..... 343/700 MS, 343/767, 770
See application file for complete search history.

(56) References Cited

U.S. PATENT DOCUMENTS

| | | | | |
|---|---|---|---|---|
| 6,501,426 | B2 | 12/2002 | Waterman | |
| 6,552,691 | B2 * | 4/2003 | Mohuchy et al. | 343/770 |
| 6,897,808 | B1 * | 5/2005 | Murch et al. | 343/700 MS |
| 7,109,926 | B2 * | 9/2006 | du Toit | 343/700 MS |

* cited by examiner

*Primary Examiner*—Shih-Chao Chen
(74) *Attorney, Agent, or Firm*—Rockwell, Figg, Ernst & Manbeck, PC

(57) ABSTRACT

A dual-pol notch step radiator that includes a plurality of notch step elements formed from three fins, aligned to form a triangular grid having a plurality of slots. The radiator also includes a plurality of current lines connecting the elements.

12 Claims, 17 Drawing Sheets

The extension to the hexagonal notch array is shown

Egg-crate notch cross-section

Axial ratio from an egg-crate antenna in the inter-cardinal scan

Cross section of concentric-fed rectangular notches.

Inter-cardinal scan of one concentric fed dual-pol rectangular notch array

Cross section of new notch transition sections

Rectangular dual pol notch array with feed in single dielectric sheet.

Stripline to Slot transition at the base of a new egg-crate radiator design.

The extension to the hexagonal notch array is shown

HEXAGONAL DUAL-POL NOTCH ARRAY ARCHITECTURE HAVING A TRIANGULAR GRID AND CONCENTRIC PHASE CENTERS

BACKGROUND OF THE INVENTION

1. Field of the Invention

The present invention relates to phased array antennas. More particularly, the present invention relates to a novel dual-pol notched array architecture having a triangular grid and concentric phase centers.

2. Description of the Related Art

Notch radiating elements for phased array antennas can be designed to support extremely large bandwidths. Notch radiating element designs have been developed that exceed ratios of 9 to 1 bandwidths. One reason for these large bandwidths is that the notch structure acts like a stepped transmission line transformer that matches from free space on to the impedance at a stripline-slotline interface. Typical arrays have a stepped notch transition with three or four stages in the transformer.

For dual polarization (dual-pol), the conventional design is the so-called "egg-crate" architecture, in which the slots are placed on the sides of a square periodic cell. FIG. 1 shows the profile of a typical egg-crate notch section 100 looking into the array. The cross sections 100 in the periodic environment act like transmission lines. Periodic modes (i.e., modes in the infinite array of the notch cross sections 100) have scan and frequency dependent propagation constants and impedances, which can be calculated using a two-dimensional periodic vector finite element code.

One problem with the egg-crate architecture is that the elements are necessarily arranged in a rectangular grid. As a result, a significant greater density of radiators and T/R modules are needed per unit area for a given scan volume relative to the triangular grid of the present invention. In addition, the polarization of the element pattern used in the egg-crate design changes with scan angle. This results from the basic physics of two propagating periodic orthogonal modes that are supported in the notch sections shown in FIG. 1, assuming that the array has been designed to avoid higher order propagating modes in the scan volume.

In an inter-cardinal plane, the notch structure of FIG. 1 has a transverse magnetic (TM) mode, which has a relative propagation constant ($k_z/k_0$) equal to 1. However, another mode propagates at a slower rate, ($k_z/k_0$)<1. Horizontal or vertical polarization for the element pattern can become circular polarized in the inter-cardinal plane as shown in FIG. 2, which shows the axial ratio from an egg-crate antenna in the inter-cardinal plane. In this example, Phi=45 and frequency was set to 13 GHz. A large value for dB axial ratio corresponds to a linear polarization, whereas a 0 dB value means that the polarization is circular. In this example the polarization is nearly at normal incidence (theta=0), becomes circular for a scan of theta=45 degrees, and tends to linear polarization again as one scans to the horizon (theta=90).

The difficulty with polarization is complicated by the fact that the phase centers for horizontal and vertical polarization are not concentric.

Alternative rectangular architectures have been attempted that consist of concentric notches in a rectangular pattern. One such example is illustrated in FIG. 3. A cross section 300 of the notch transition is shown in FIG. 3 in which the slots 302 are at the corners of a square rectangle.

Such concentric rectangular notched arrays are used with the objective to produce concentric phase centers that coincide for both vertical and horizontal polarizations, to enable easier compensation for changes in polarization. Although the arrangement of rectangular notched arrays is that of a rectangular grid, this architecture has been shown to have significant scan problems for the TE scan in the inter-cardinal plane. Exemplary results from simulation of a full radiator element are shown in FIG. 4. As shown in FIG. 4, the TE scan completely fails at about 25°. This scan failure has been observed both in finite element analysis of periodic arrays as well as measurements of experimental arrays.

The reason for the failure of the concentric fed rectangular array is related to the number and characteristics of the propagating modes in the notch transition. A two dimensional (2-D) periodic finite element analysis of the transmission properties of rectangular concentric notch fins as a periodic transmission line shows three propagating modes. Two modes have a relative propagation constant of $k_z/k_0$ equal to 1. One of these two modes always has its electric field in the TM plane. The third mode has $k_z/k_0$ less than 1.

In the inter-cardinal plane, the waveguide mode and one of the TEM modes both carry a quadrature piece of the field, which does not radiate well because this field varies faster than the fundamental free space plane wave. This results in poor scan performance.

As an illustration of this behavior, FIG. 5 shows the three propagating modes supported by a periodic transmission line structure consistence of four metal fins per cell. The periodic boundary conditions support scanning off normal to a direction (theta,phi)=(60,30). The fields within a periodic cell are displayed. Each of the six cells in the figure corresponds to the cross section or the radiator periodic cell just above the stripline-slotline transition. Because the array has been scanned to show the undesired behavior, the modes supported by the periodic transmission line structure are fields with real and imaginary components. These are graphically displayed in FIG. 5 by showing the portion in-phase with the field at the center and the portion 90 degrees out of phase (quadrature) at the center. At the stripline-notch transition, the quadrature components in the first and third modes cancel, which can be seen from the direction of the quadrature fields in FIG. 5 (b1) and (b3). The significant result, however, is that as modes 1 and 3 propagate with different propagation constants, the cancellation of the quadrature part between these two modes diminishes because they are no longer synchronized. This quadrature part will not radiate well because it varies more quickly than the fundamental radiated plane wave pair. A similar behavior exists for steps with a wider slot dimension.

Thus, there is a continued need for new and improved radiating architectures that address the above-described problems with prior solutions.

SUMMARY OF THE INVENTION

According to an embodiment of the present invention, a Dual-Pol notched array includes a triangular grid comprising metal fins of the notches form an array of hexagons. At the "throat" (base) of each radiating element near a stripline-slotline transition, three metal sheets form a slot structure. Three elements contact each hexagon with two fins from each radiator forming the hexagon.

The present invention has several non-limiting advantages and features:

First, unlike the egg-crate architecture of notch arrays, the present invention has an equilateral triangular grid, meaning that the number of radiating elements and associative circuitry is reduced by a significant factor.

Second, unlike a concentric rectangular dual-pole notch structure, which will not scan the TE polarization well in the inter-cardinal planes, the present invention can support only two orthogonal modes and scans well.

Third, unlike an egg-crate architecture, the hexagonal notch structure of the present invention has concentric phase centers, and is therefore much easier to adjust polarization purity in the inter-cardinal plane.

Fourth, the present invention includes a feed that has been devised for supporting vertical and horizontal polarizations using a single dielectric sheet parallel to the aperture.

According to an embodiment of the present invention, a dual-pol notch step radiator is provided that includes notch step elements formed from three fins aligned to form a triangular grid having a plurality of slots. The radiator also includes a plurality of current lines connecting the elements.

According to another embodiment of the present invention, a dual-pol notch step radiator is provide which includes triangular grid means for forming a plurality of triangular slots. The radiator also includes a plurality of exciting means for effecting vertical and horizontal polarization.

Further applications and advantages of various embodiments of the invention are discussed below with reference to the drawing figures.

DETAILED DESCRIPTION OF THE PREFERRED EMBODIMENTS

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

Figure 1:
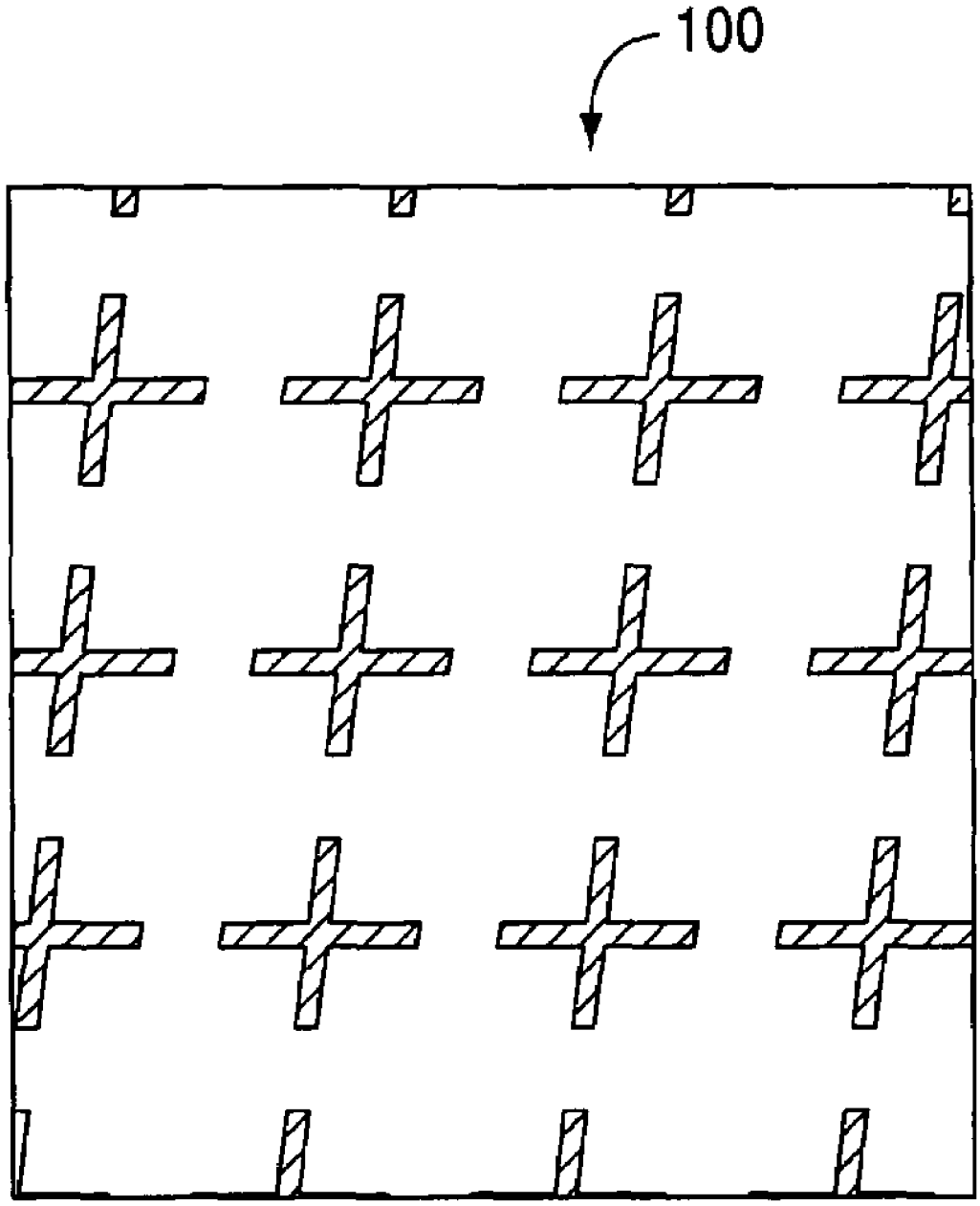
Fig.1 Prior Art
FIG. 1 shows a cross-section of a prior art egg-crate notch structure.
Figure 2:
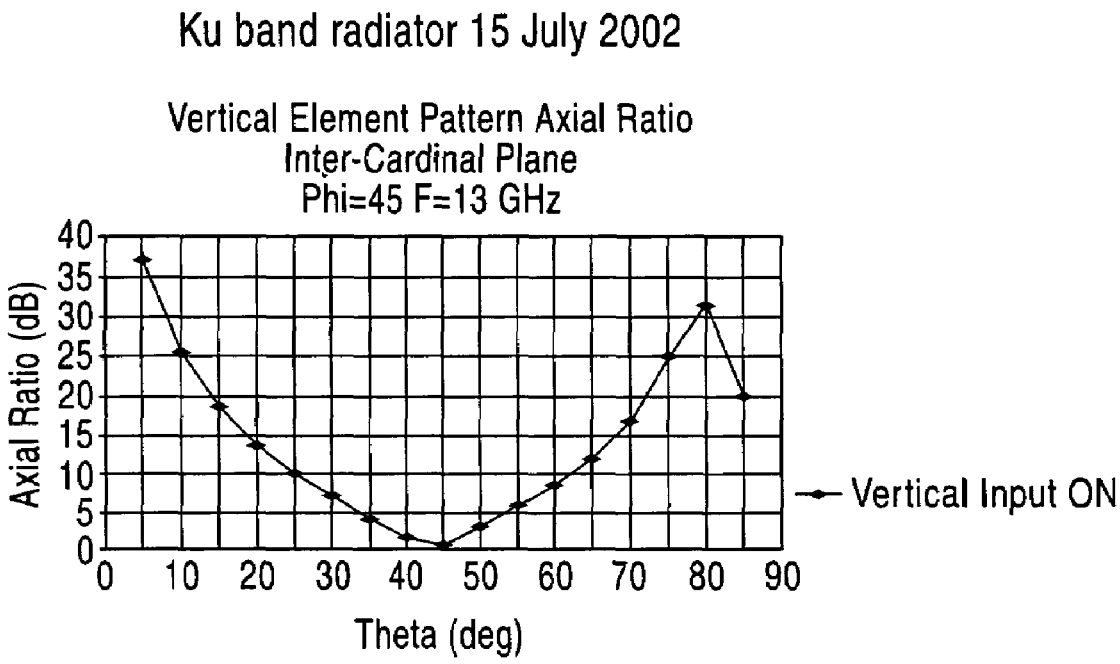
Fig.2 Prior Art
FIG. 2 shows an axial ratio from the egg-crate antenna in the inter-cardinal plane.
Figure 3:
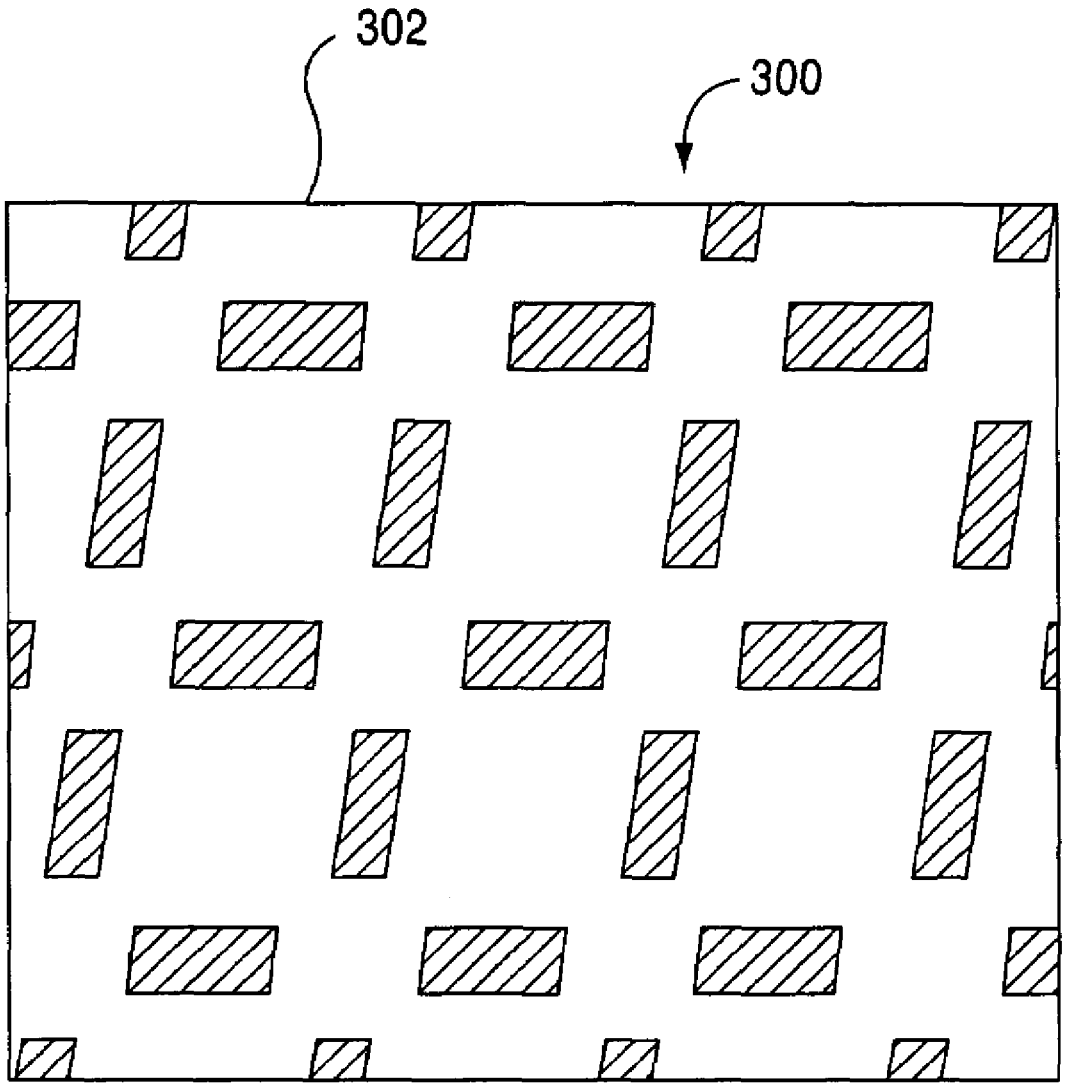
Fig.3 Prior Art
FIG. 3 shows a cross-section of prior art concentric-fed rectangular notches.
Figure 4:
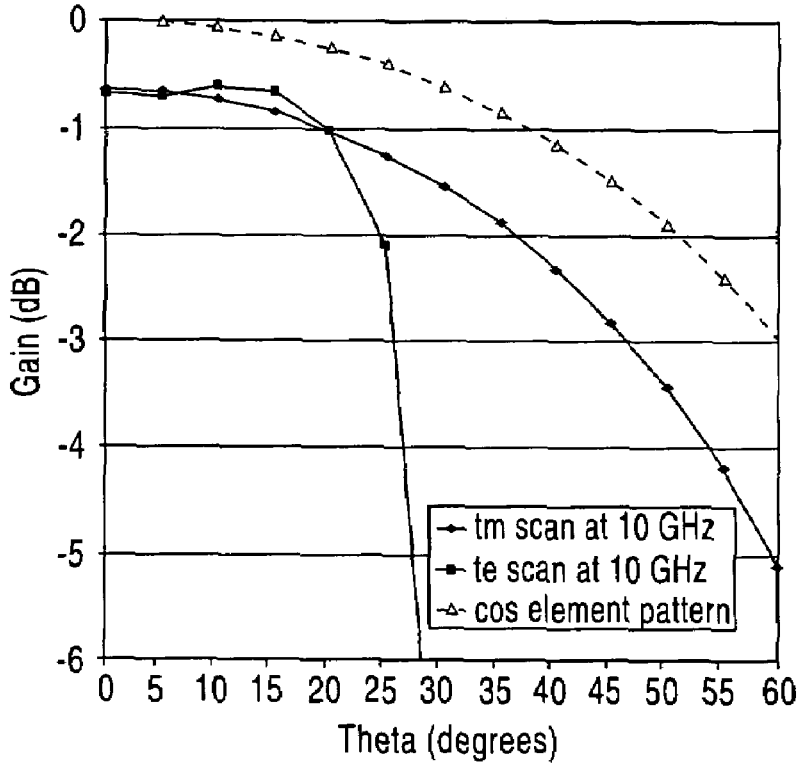
Fig.4 Prior Art
FIG. 4 shows a graph of an inter-cardinal scan of one concentric fed dual-pole rectangular notch array.
Figure 5:
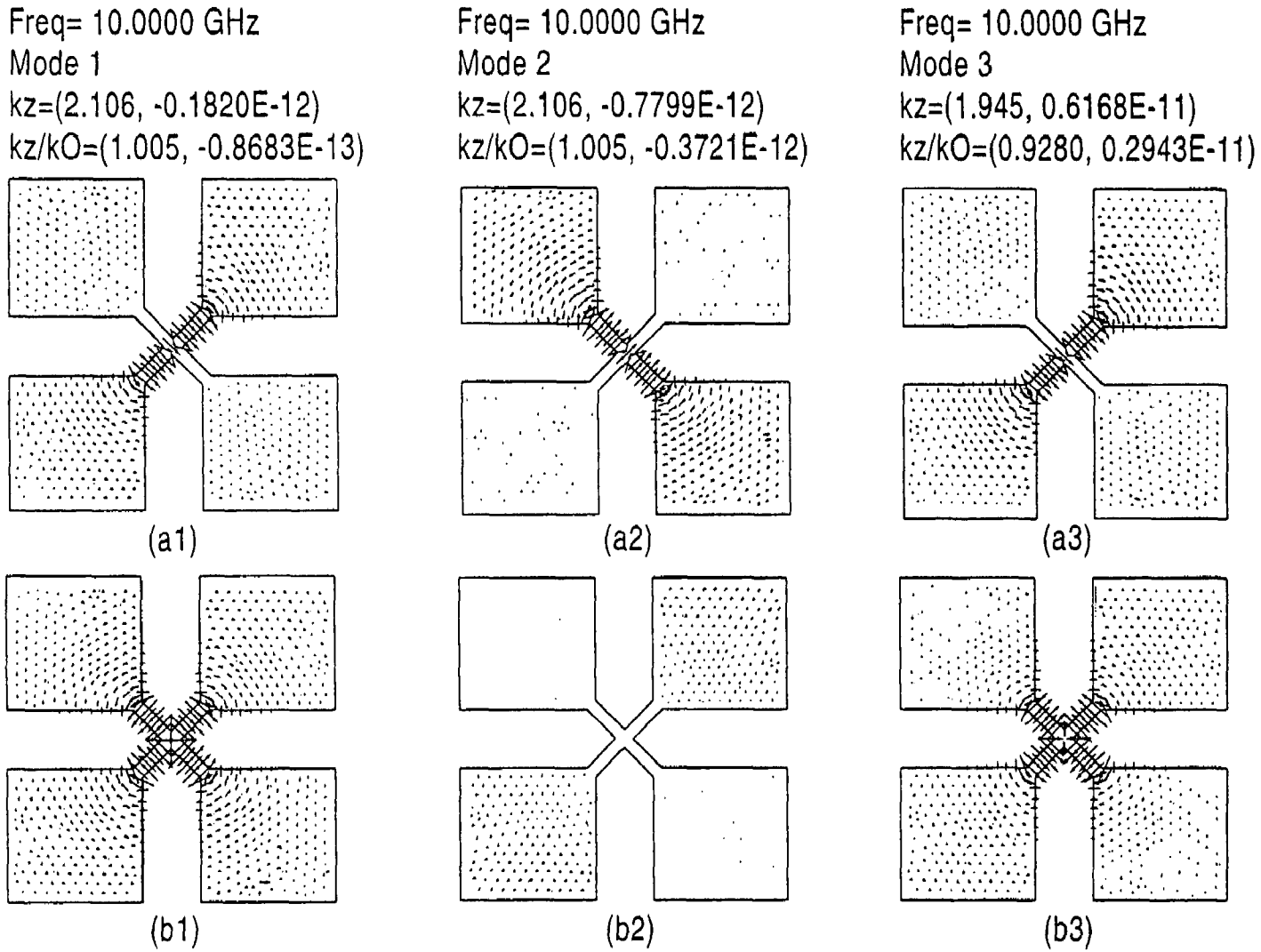
Fig.5 (PRIOR ART)
FIG. 5 shows three propagating modes for notch near stripline-slotline transition showing in-phase and quadrature-phase components of a prior art arrangement.

It can be observed from the impedances for the modes in FIG. 5 (the concentric phase rectangular notch architecture) that the impedances obey a quasi-static model. From this perspective, three modes can be considered to exist because the unit cell for the concentrically fed notch antenna has four pieces of metal at different potentials. In the egg-crate architecture, this same potential model shows two sets of two pieces of metal at different potentials resulting in a total of two modes.

In the present invention, a dual-pol notch propagating structure with three metal fins forms a triangular grid. This novel architecture yields a propagating structure with only two propagating modes and consequently avoids the problems of having an unwanted mode propagating. According to an embodiment of the present invention, notch transition sections 600 each have the cross section like the one shown in FIG. 6.

Figure 6:
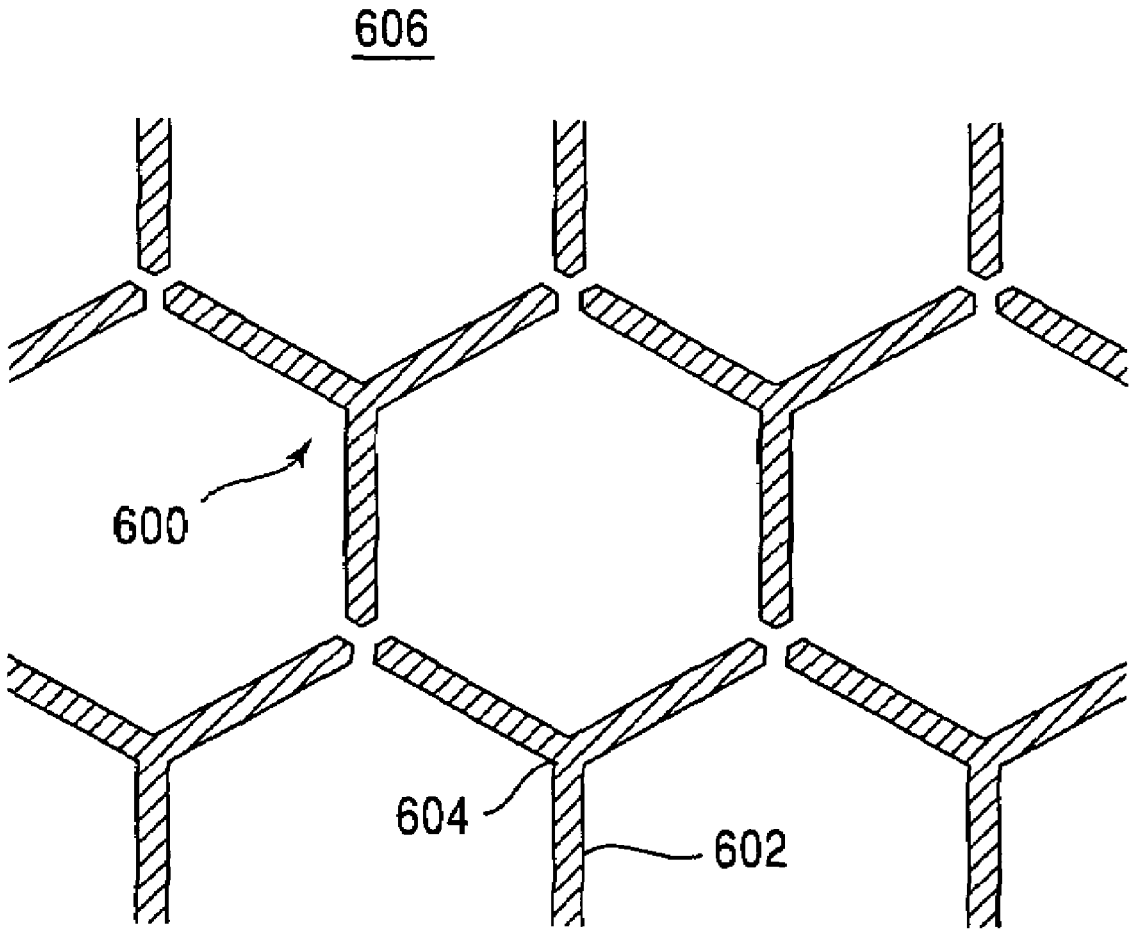
FIG. 6 shows a cross-section of notch transition sections of a triangular grid.

In FIG. 6, fins 602 on a dielectric sheet 606 connect a strip line (not shown) at a center point 604. The notch sections 600 are laid out in an array such that a hexagonal structure is created, which creates concentric phase centers. A periodic finite element analysis of the propagating modes shows that indeed, only two modes will propagate in the structure of FIG. 6.

Figure 7:
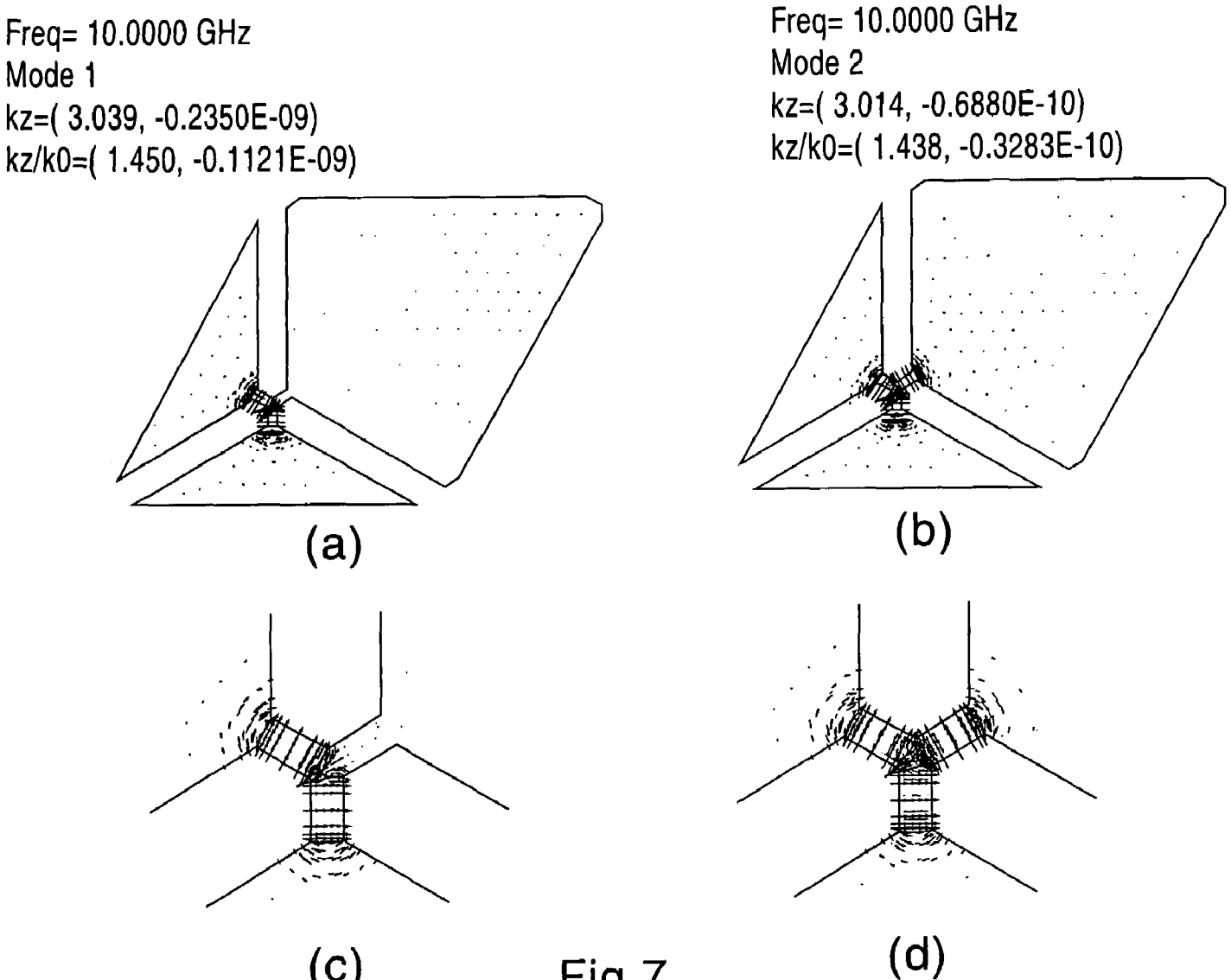
FIG. 7 illustrates modes calculated in periodic cell of hexagonal notch array's propagating notch scanned in the inter-cardinal plane.

FIG. 7 shows modes calculation in periodic cell of hexagonal notch array's propagating notch scanned in the inter-cardinal plane at theta (degrees from normal)=60 and Phi=30. The mode in the TM plane of incidence always has $k_z/k_0=1$, while the other mode has $k_z/k_0$ less than 1. This notch propagating structure is expected to exhibit changes in polarization in its element pattern as the array is scanned. However, the phase centers for radiating vertical and horizontal polarizations are concentrically located, which facilitates the compensation of non-linear polarization. Also, there are different principal planes from the rectangular array with symmetries located at 120 degree planes, which can be exploited.

The present invention supports dual-polarized modes with a concentric feed. Further, because the grid architecture for the propagating structure is triangular, the number of elements needed per unit area is reduced relative to the rectangular notch arrays.

Vertical and horizontal polarizations are excited in the hex-notch array at the base of the notch transition. Because there are three arms to the notch radiator instead of two or four, it is essential to construct the feed so that coupling will not occur between the input ports. As a model for the feed, a recently developed dual-pol egg-crate feed in which the stripline feed is restricted to a single dielectric substrate parallel to the plane of the array is shown in FIGS. 8-9.

Figure 8A:
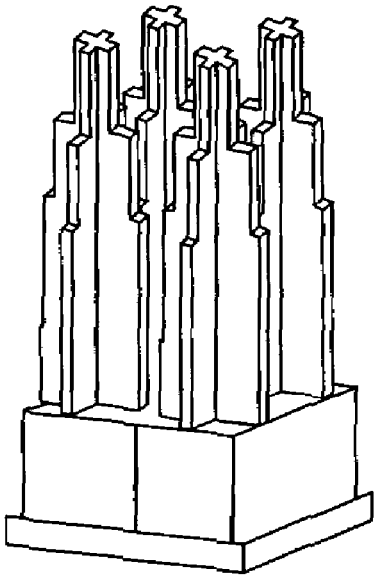
FIGS. 8-8*b* show a rectangular dual-pol notch array with feed in single dielectric sheet.
Figure 8A:
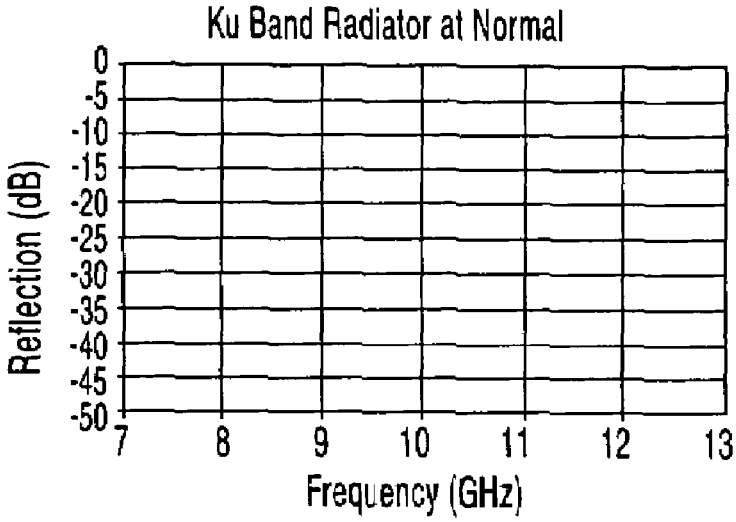
Figure 8B:
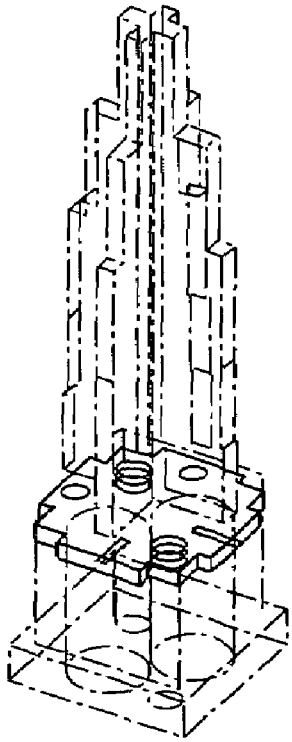
Figure 9:
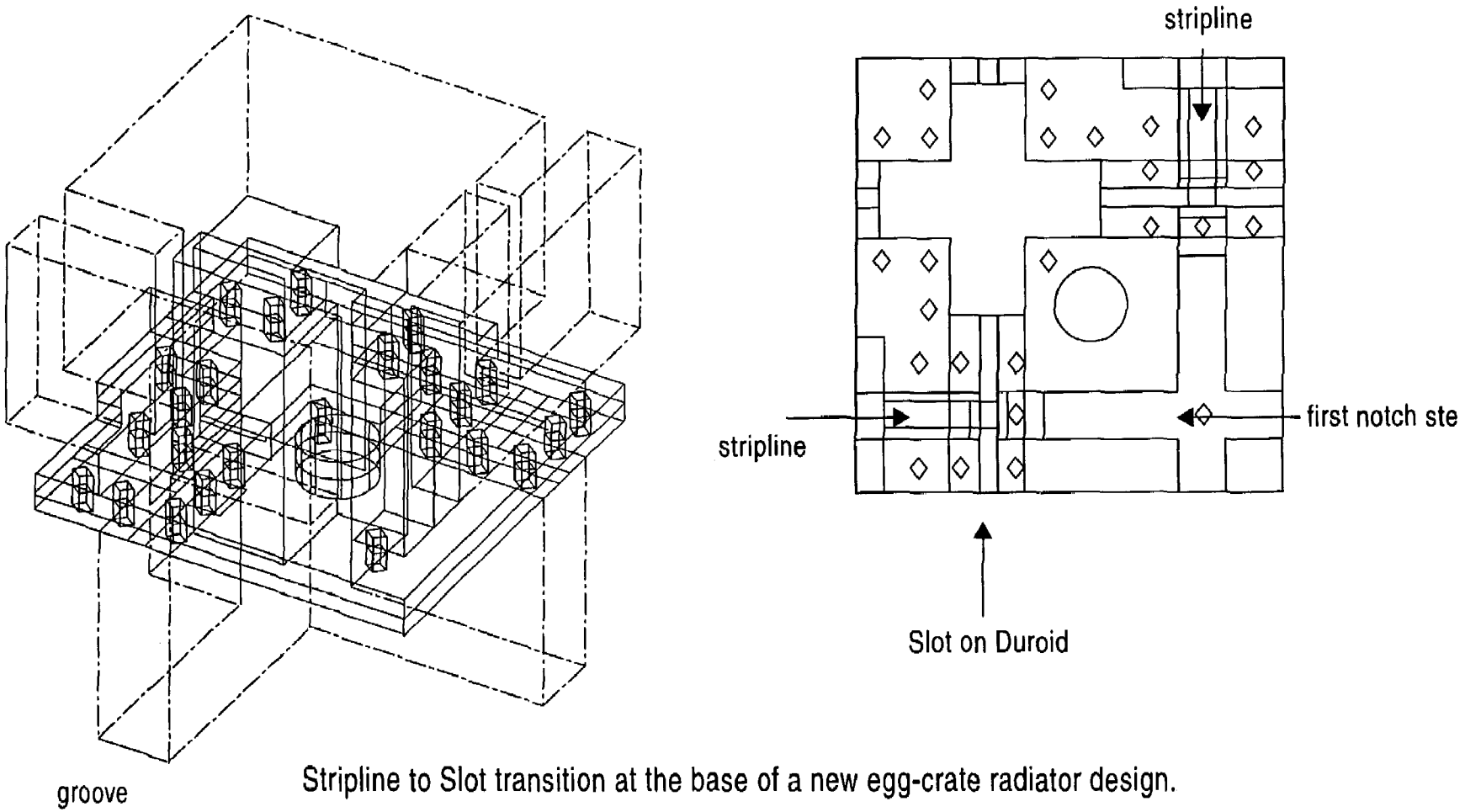
FIG. 9 shows a Stripline-to-Slot transition at the base of a novel egg-crate radiator design.

FIGS. 8*a*-*b* show a rectangular dual-pol notch array with feed in single dielectric sheet. The stripline-to-slot transition for this rectangular array is shown in FIG. 9. This device has many similarities to the feed transition used in the "Frisbee" radiator except that the bandwidth is considerably greater because true notch transition is constructed. GPPO connectors (manufactured by W. L. GORE & ASSOCIATES, INC.) are used to connect to striplines in the dielectric sheet.

Current is injected across the base of the slots that form the notches.

The power delivered to the slots is proportional to the current injected and the electric field in the slot mode that one wishes to excite. Using a pin to short the stripline across the slotline on the dielectric card, one maximizes the current. Placing a grooved periodic cavity region backed by a ground plane below the point where current is injected across the slot maximizes the modal field the stripline. Basically, a short at the base of the grooved region is pulled to a high impedance by placing the transition a quarter of a wavelength above the base of the groove.

Figure 10:
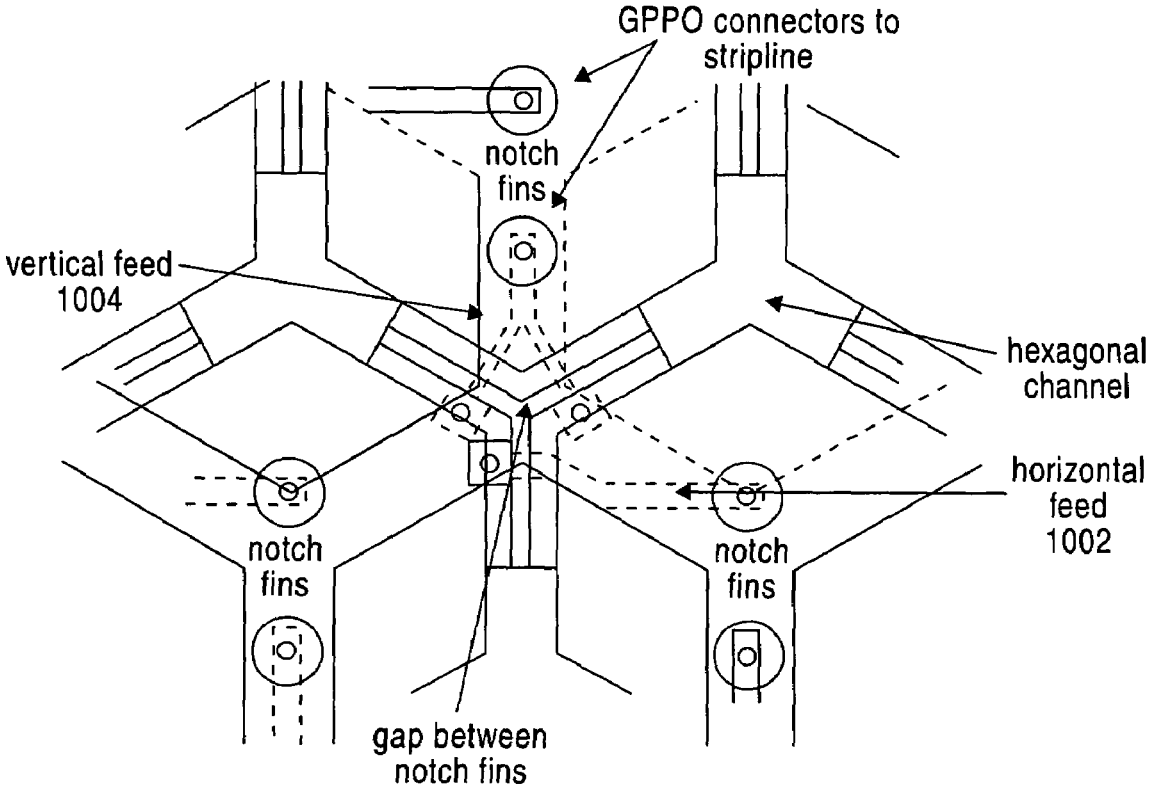
FIG. 10 shows feeding horizontal and vertical modes in a hexagonal notch array.

An extension to the hexagonal notch array is shown in FIG. 10. The key concept in this feed for the hexagonal array is that the horizontal polarization is excited by injecting current across one of the slots formed at the junction at the mouth of the hexagonal notch transition via horizontal feed 1002. For vertical polarization, one must inject the current from the second stripline 1004 across both of the other slots to excite the vertical polarization. Had the second stripline connector been connected to only across one of the other slots between the notch fins, there would be coupling between the two input striplines. In other words it is essential to excite orthogonal polarizations at the base of the hexagonal structure.

One should note that the vertical feed should not end in two shorted pins because such an arrangement would short out the horizontal feed. In other words, the ends of the vertical feed should be regarded as low impedance flags that pull a stripline open back to a short.

Figure 11:
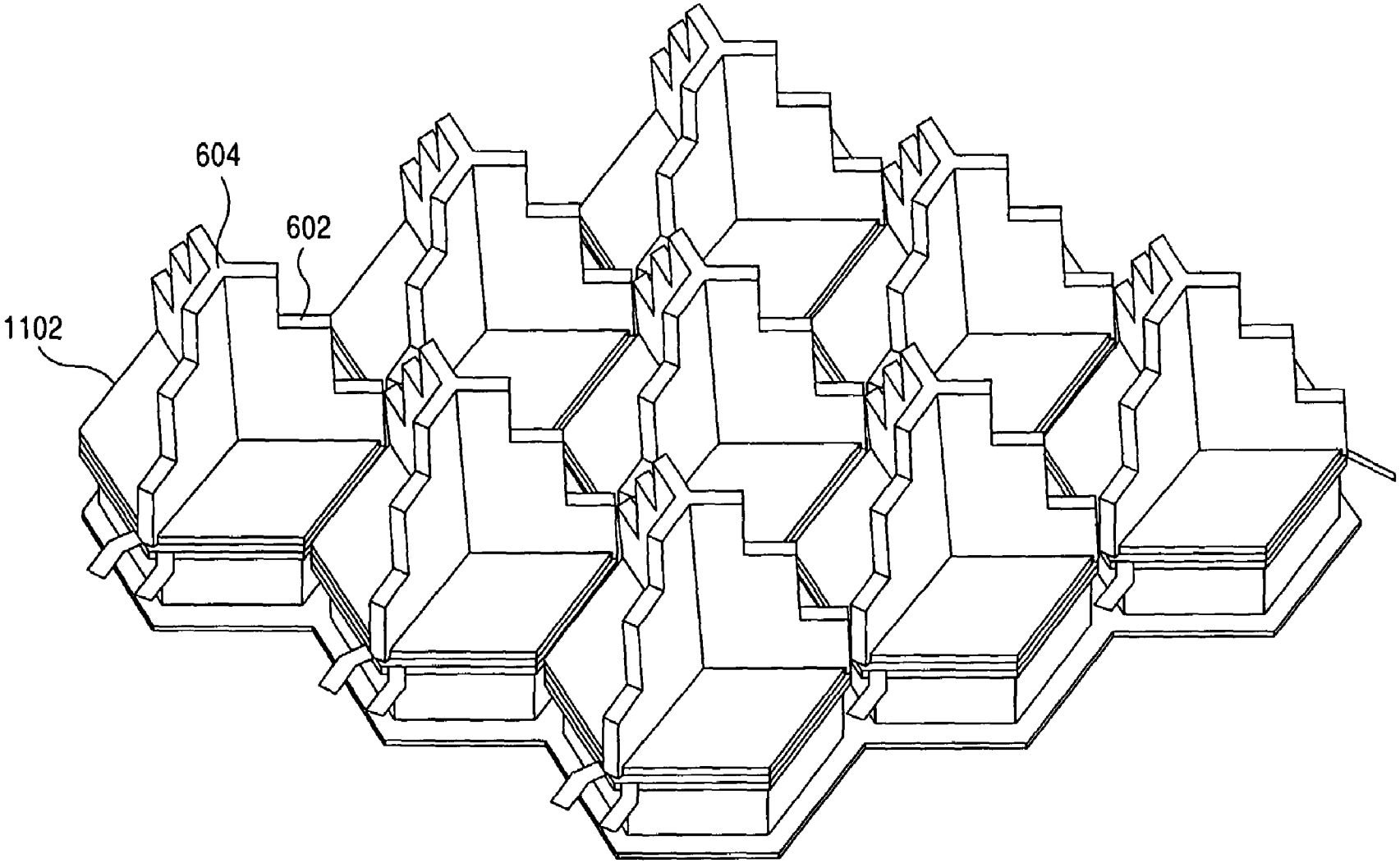
FIG. 11 is a perspective view of the triangular gird of an embodiment of the present invention.
Figure 12:
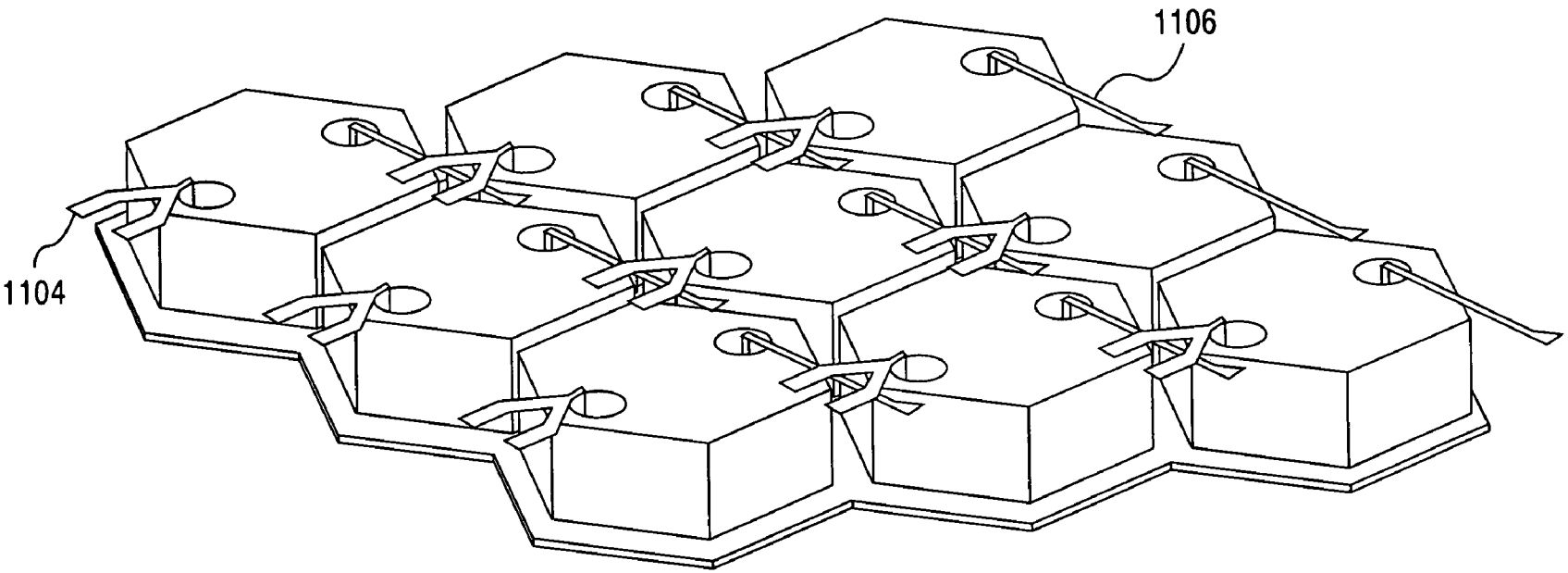
FIG. 12 is a perspective view of a hexagonal trough radiator according to an embodiment of the present invention.

A triangular grid is shown in FIGS. 11-16 according to a second embodiment of the invention. In FIG. 11, a perspective view of the triangular grid is shown. As shown, triangular elements 604 are constructed of fins 602 on hexagonal elements 1102. As shown in FIG. 12, the hexagonal elements 1102 are connected by striplines 1104 (vertical feeds) and 1106 (horizontal feeds). Trough modes are excited by the horizontal current line 1106 and vertical current line. These can be fed by GPPO coaxial adapters. Note that current lines 1104 and 1106 are in different planes and do not intersect.

There are three planar dielectric layers with striplines on the interface of two layers. The rest of the hexagonal elements are metal.

Figure 13A:
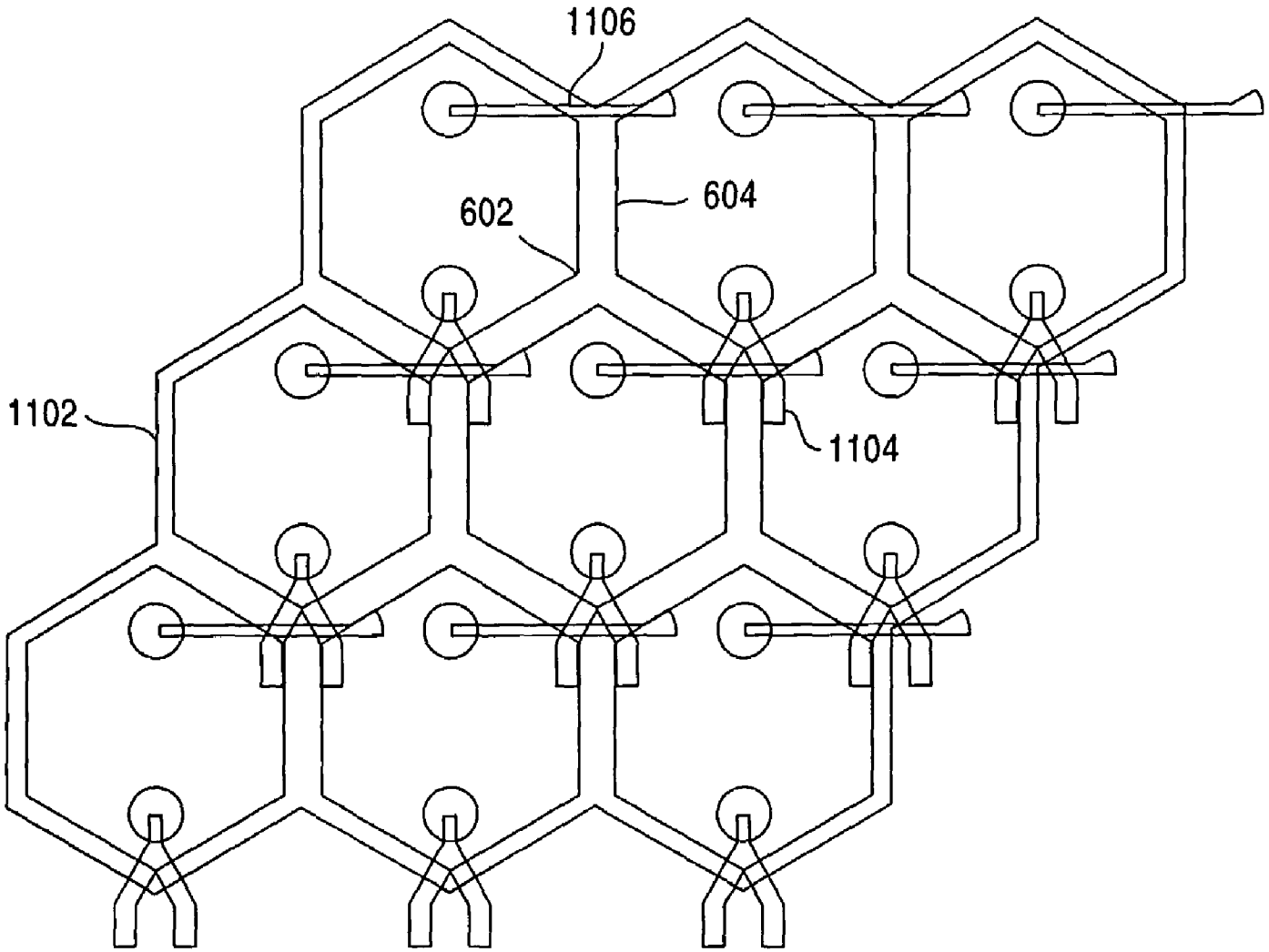
FIG. 13*a* shows as top view or the trough balun feed.

FIG. 13*a* shows a diagram of the trough balun feeds of the device of this embodiment. Current stripline paths (1104, 1106) end in opens, which are pulled back to a low impedance over the gap, which is the trough grooved channel. The point of low impedance is where the striplines are over the channel.

Figure 13B:
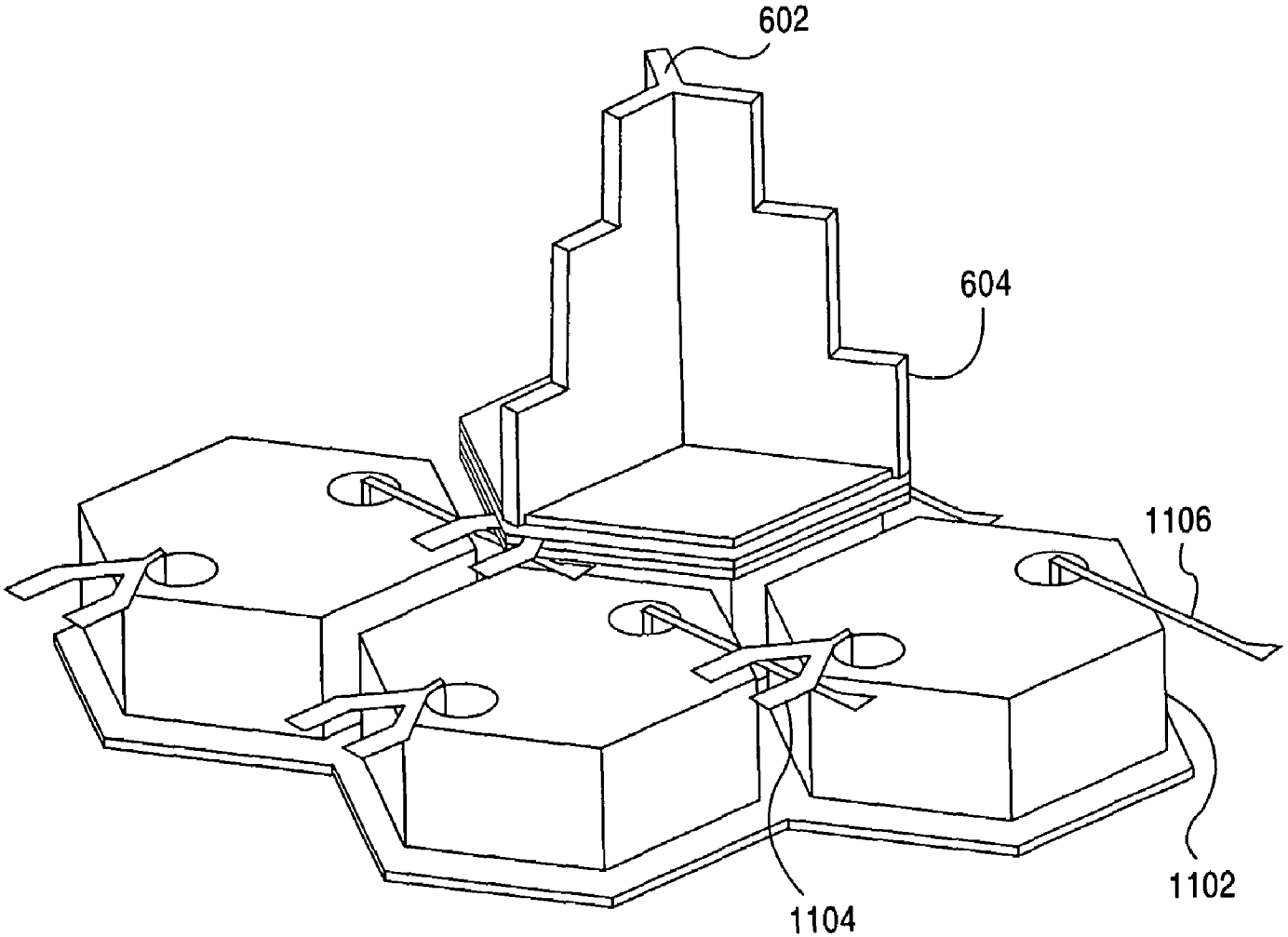
FIG. 13*b* shows the relation of the hex fins to feed.
Figure 14:
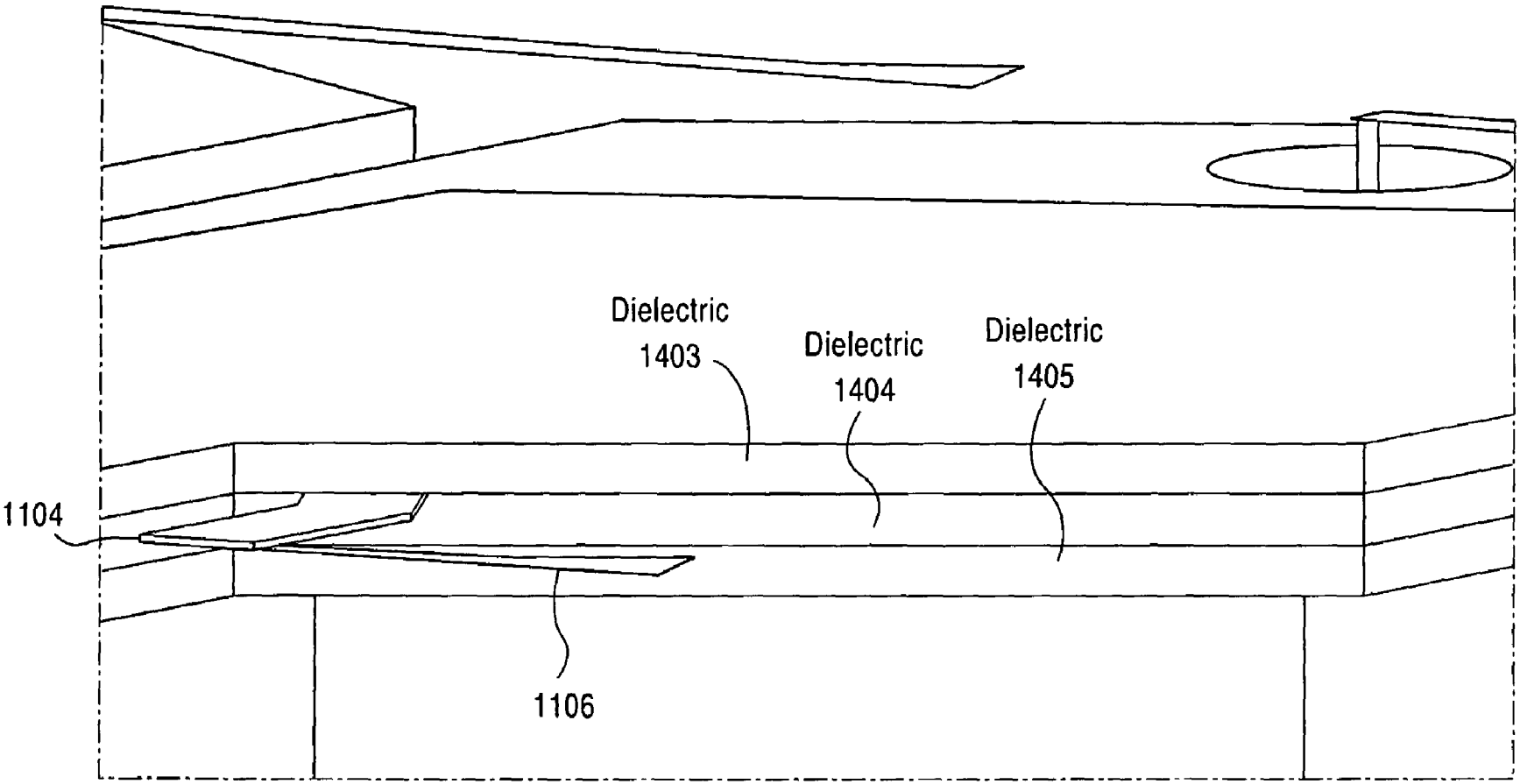
FIG. 14 shows a stripline formed from three dielectric layers.
Figure 15:
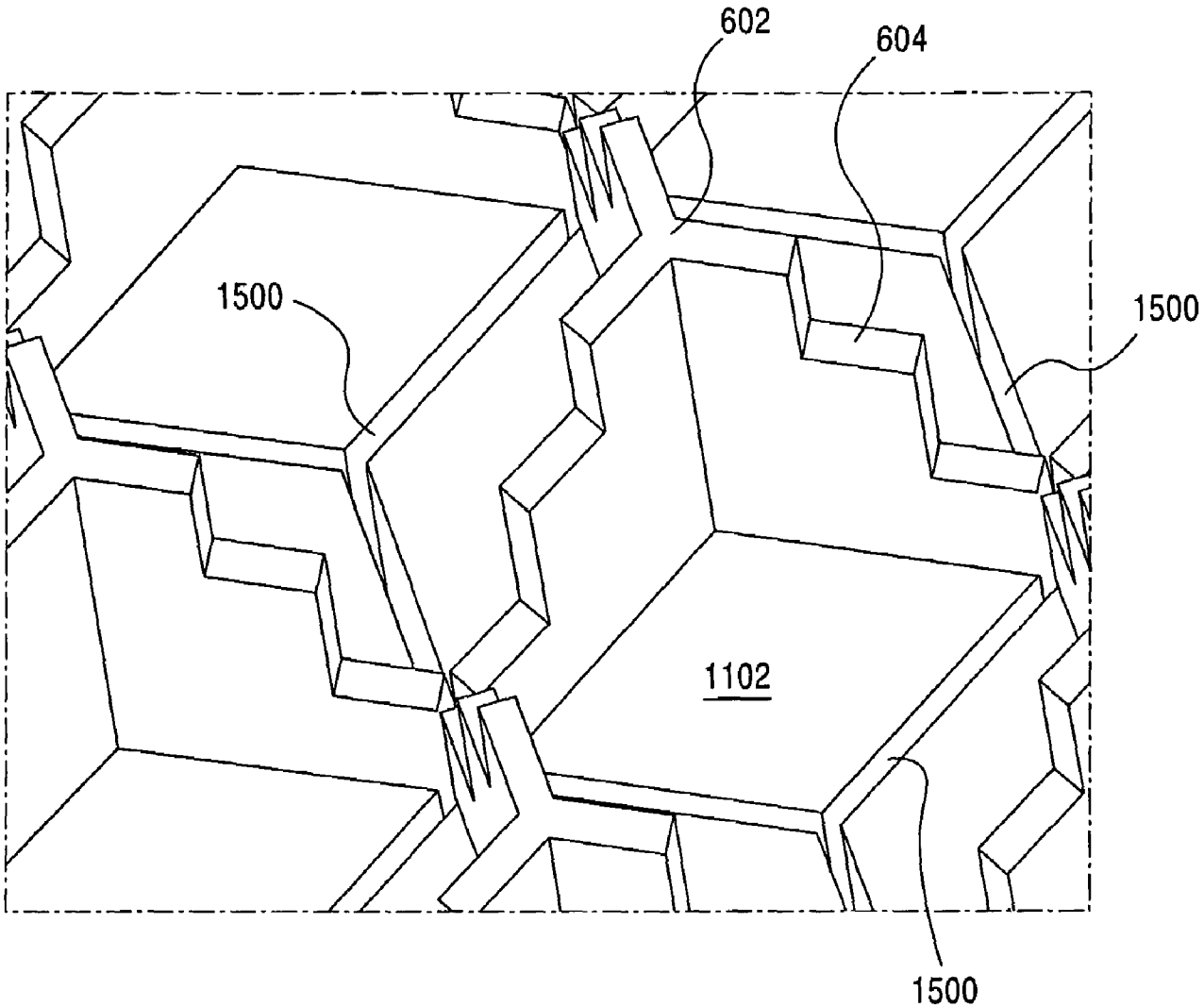
FIG. 15 shows fins form stepped periodic slotline transformer to free space.

FIG. 13*b* is a perspective view showing only one triangular grid to show the relation between the hexagonal elements 1102 and the triangular fins 602,k 604. As shown in FIG. 14 in more detail, three dielectric layers 1403-1405 are used to isolate the current lines 1106 and 1104. As shown in FIG. 15 the fins form a stepped periodic slotline impedance transformer 1500 to free space.

Figure 16B:
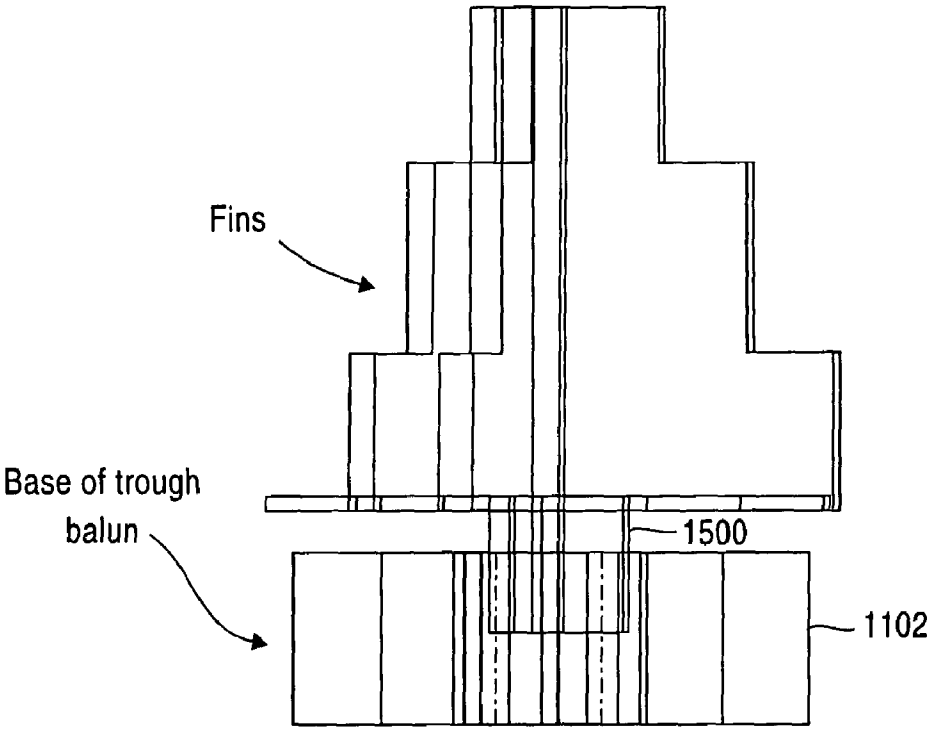
FIG. 16 shows the fins being electrically grounded to the base.
Figure 16A:
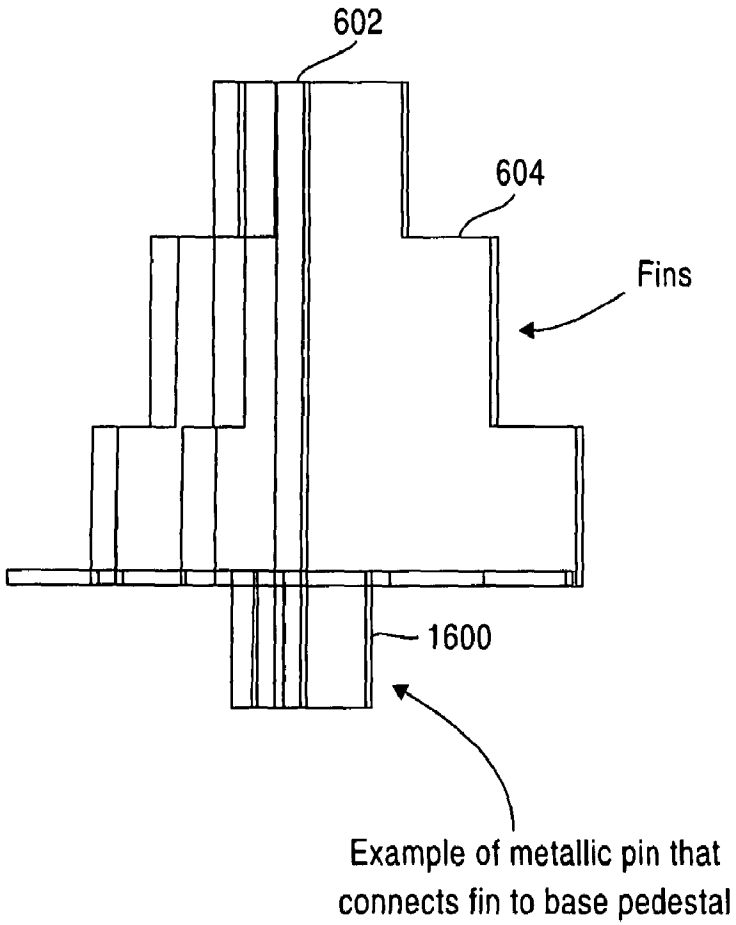

FIGS. 16A and 16B show a side views respectively of the fin and of the fin and base of the device. The fins 602, 604 can be electrically grounded to the base 1102 by, for example, a metallic pin 1600 that connects the fin to the base. The pin 1600 slides into groves in the balun 1102.

Thus, a number of preferred embodiments have been fully described above with reference to the drawing figures. Although the invention has been described based upon these preferred embodiments, it would be apparent to those of skilled in the art that certain modifications, variations, and alternative constructions would be apparent, while remaining within the spirit and scope of the invention.

I claim:

1. A dual-pol notch step radiator, comprising:

notch step elements formed from three fins aligned to form a triangular grid having a plurality of slots, wherein the elements have concentric phase centers for vertical and horizontal; and a plurality of current lines connecting the elements.

2. A dual-pol notch step radiator, comprising:

notch step elements formed from three fins aligned to form a triangular grid having a plurality of slots; and a plurality of current lines connecting the elements, wherein said current lines include at least one horizontal current line and one vertical current line between each element for actuating horizontal and vertical polarization respectively.

3. A dual-pol notch step radiator, comprising:

notch step elements formed from three fins aligned to form a triangular grid having a plurality of slots;

a plurality of current lines connecting the elements; and a plurality of hexagonal bases on which each element is positioned and a plurality of dielectric layers separating each said element from each said base, said dielectric layers insulating each said current line.

4. The radiator of claim 3, where each said element is electrically grounded to the base upon which it is positioned.

5. The radiator of claim 4, wherein each said element is electrically grounded to the base upon which it is positioned by a metallic pin formed in the element.

6. A dual-pol notch step radiator, comprising:

triangular grid means for forming a plurality of triangular slots, wherein said triangular grid means includes a plurality of three-pronged elements having a center, formed on hexagonal bases; and a plurality of exciting means for effecting vertical and horizontal polarization.

7. The radiator of claim 6, wherein the three-pronged elements are notched from the outside to the inside, such that the center, where the three prongs connect, has a height greater than that of edges of each of the prongs.

8. The radiator of claim 7, wherein the elements have concentric phase centers for vertical and horizontal polarization.

9. The radiator of claim 6, wherein said exciting means includes horizontal current lines and vertical current lines between elements of said triangular grid means for actuating horizontal and vertical polarization respectively.

10. The radiator of claim 6, further comprising hexagonal base means on which said triangular grid means is formed, said base means including insulation means for insulated said exciting means from said hexagonal base means.

11. The radiator of claim 7, wherein each element is electrically grounded to the base upon which it is positioned.

12. The radiator of claim 11, wherein each said element is electrically grounded to the base upon which it is positioned by a metallic pin formed in the element.

* * * * *